United States Patent [19]

Hsieh

[11] Patent Number: 4,998,344

[45] Date of Patent: Mar. 12, 1991

[54] METHOD OF MANUFACTURING A HUB

[76] Inventor: Kin Ho Hsieh, No. 125, Shih Chien St., Feng Yuan City, Taiwan

[21] Appl. No.: 499,793

[22] Filed: Mar. 27, 1990

[51] Int. Cl.[5] ..... B21K 1/40

[52] U.S. Cl. ..... 29/894.362; 29/412; 72/356; 72/68

[58] Field of Search ..... 29/894.362, 412, 414; 301/105 B; 72/356, 353, 354, 76, 68

[56] References Cited

U.S. PATENT DOCUMENTS 504,888 9/1993 Nessel et al. ..... 301/105 B 4,464,917 8/1984 Kienhöfer ..... 72/76

*Primary Examiner*—P. W. Echols

*Attorney, Agent, or Firm*—Hamilton, Brook, Smith & Reynolds

[57] ABSTRACT

A method of manufacturing a hub includes the following steps: rotary swaging a workpiece to form a semi-product, the workpiece is simultaneously struck by three or more dies from the outer peripheral side so that the semi-product is formed smoothly and homogeneously, and two bearing cup seats are simultaneously formed on both ends of the semi-product; and squeezing both ends of the semi-product by a right mold and a left mold so as to form a hub. The hub is produced in a fast speed so that the productivity is greatly increased.

1 Claim, 3 Drawing Sheets

METHOD OF MANUFACTURING A HUB

BACKGROUND OF THE INVENTION

The present invention relates to a method, and more particularly to a method of manufacturing a hub of a cycle or other wheel.

Various types of hubs for cycle and other wheels are developed. Four of these are disclosed in G.B. Patent No. 17,142 to Dawes; French Patent No. 475,722 to d'Armes; French Patent No. 452,387 to Trinks; and Italy Patent No. 716,342 to Edourdo. In Dawes' and Edourdo's patents, liners or reinforcements should be inserted into the integral spoke flanges, it takes at least 30 minutes to insert the reinforcements into positions, therefore, it takes at least 40 minutes to make one hub, the productivity thereof is very poor. In addition, both ends of the hub of Dawes' patent are expanded, and then, both ends are squeezed. In order to expand both ends of the hub, a mandrel should be inserted into the tube from which a hub is to be formed. After expansion, it is difficult to take the mandrel out of the tube. This method is impractical. In d'Armes' and Trinks' patents, the hubs thereof are generally manufactured by rolling process, a roller rotates or rolls around a tube from which a hub is formed. The outer peripheral surface of the tube is forced or compressed gradually or helically by the rollers so that a compression of the tube is not homogeneous. The tube may be deformed. In addition, a hub formed by this method requires at least 30 minutes, which is time consuming. The productivity thereof is also poor. A hub producing process was proposed and filed by the inventor in his prior U.S. patent application No. 06/828,595, filed Feb. 11, 1986, now abandoned. It takes about 3 minutes to produce one hub. But, the tube is not compressed homogeneously.

The present invention has arisen to improve the manufacturing of the hub so that the hub can be produced in a fast speed.

SUMMARY OF THE INVENTION

The primary objective of the present invention is to provide a method of manufacturing a hub, in which the hub can be manufactured in a fast speed.

Another objective of the present invention is to provide a method of manufacturing a hub, in which the tube from which a hub is formed is simultaneously swaged by at least three molds from the outer peripheral surface thereof so that a hub of precise shape and of smooth outer peripheral surface is formed.

In accordance with one aspect of the invention, there is provided a method of manufacturing a hub which comprises the following steps: rotary swaging a workpiece which is substantially a cylindrical tube so as to form a semi-product, the workpiece is struck or swaged by at least three dies from the outer peripheral side of the workpiece, the dies simultaneously strike the workpiece in a pulsating hammer-type action so that the semi-product is formed smoothly and homogeneously, and two bearing cup seats are formed on both ends of the semi-product, it takes about only 10 to 15 seconds to form a semi-product; and squeezing both ends of the semi-product, a center portion of the semi-product is embraced by an upper mold and a lower mold, and both ends of the semi-product are squeezed by a right mold and a left mold so as to form a hub, it takes about 5 seconds to perform this process. The hub is produced in a fast speed, from 15 to 20 seconds, so that the productivity thereof is greatly increased.

Further objectives and advantages of the present invention will become apparent from a careful reading of the detailed description provided hereinbelow, with appropriate reference to the accompanying drawings.

DETAILED DESCRIPTION OF THE INVENTION

A method of manufacturing a hub in accordance with the present invention comprises the following steps:

(1) Rotary swaging a workpiece 1 which is generally a cylindrical tube so as to form a semi-product.

Figure 1:
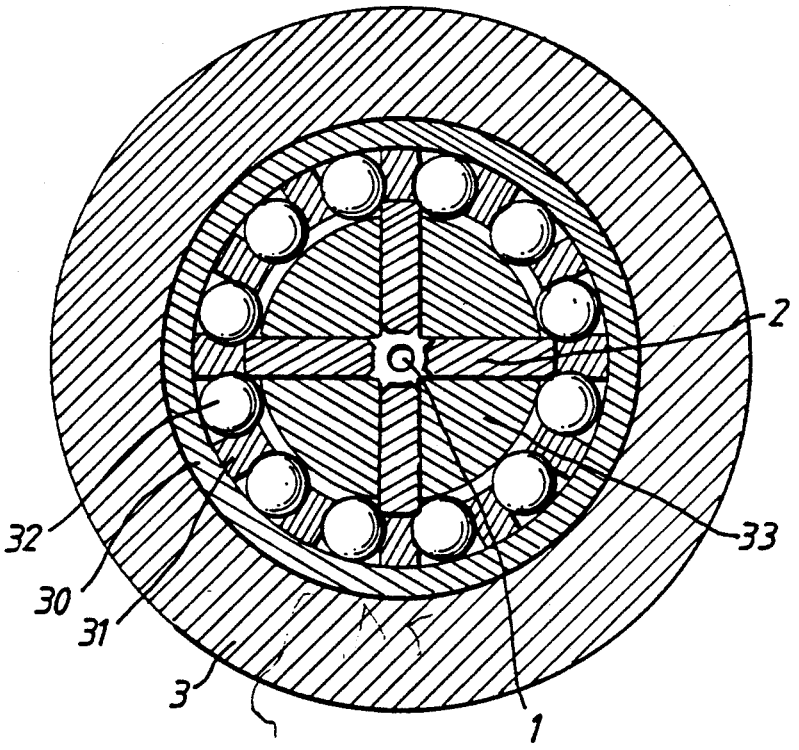
FIG. 1 is a cross sectional view of a machine employed in a rotary swaging process of a method of manufacturing a hub in accordance with the present invention.

Referring to the drawings and particularly to FIG. 1, illustrated is a machine employed in the rotary swaging process of the method. The machine comprises a rotatable ring 3; an inside ring 30 fixed in the rotatable ring 3; a roller bearing disposed in the inside ring 30, the roller bearing including a rack 31 and a plurality of rollers 32; and a stationary spindle 33 disposed in the roller bearing, four channels of a cross shape being formed in the stationary spindle 33 for receiving four dies 2, the dies 2 being slidable along the respective channels of the stationary spindle 33, a predetermined shape corresponding to the hub to be made being formed on the inner end of each die 2.

The workpiece 1 is insertable into the stationary spindle 33. When the rotary ring 3 and the roller bearing rotate, the rollers 32 pass over the rear ends of the dies so that the dies strike the workpiece in a pulsating hammer-type action. It is to be noted that the workpiece 1 is simultaneously hammered or struck by the four dies 2 so that the workpiece 1 is formed smoothly and homogeneously.

Figure 2:
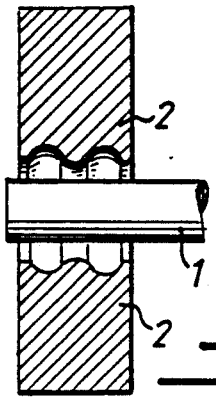
FIGS. 2, 3 and 4 are cross sectional views, illustrating a sequence of a rotary swaging process of the method.
Figure 3:
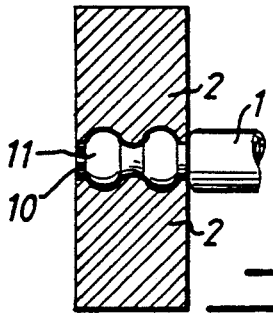
Figure 4:
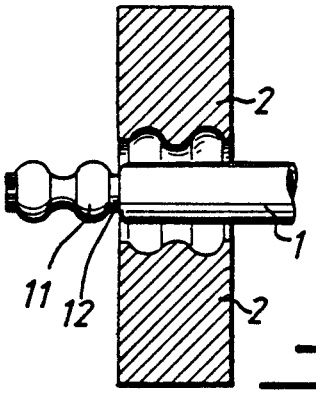

Referring next to FIGS. 2, 3 and 4, the workpiece 1 is hammered by the dies 2 to form a semi-product 11 which has two bearing cup seats 10, 12 simultaneously formed on both ends thereof. The dies 2 are pushed outwards relative to the stationary spindle 33 when the workpiece 1 is either pushed forward or pulled rearward relative to the dies 2, as shown in FIG. 4. Normally, it takes about 10 to 15 seconds to form such a semi-product 11. Push the workpiece 1 forward so that the semi-product 11 leaves the dies 2, and repeat rotary swaging the other portion of the workpiece which has not been hammered yet until the remains of the workpiece 1 is not long enough for a semi-product 11. Therefore, several semi-products are formed on the tube 1 in series.

(2) Cutting the tube 1 into each single semi-product 11.

Figure 5:
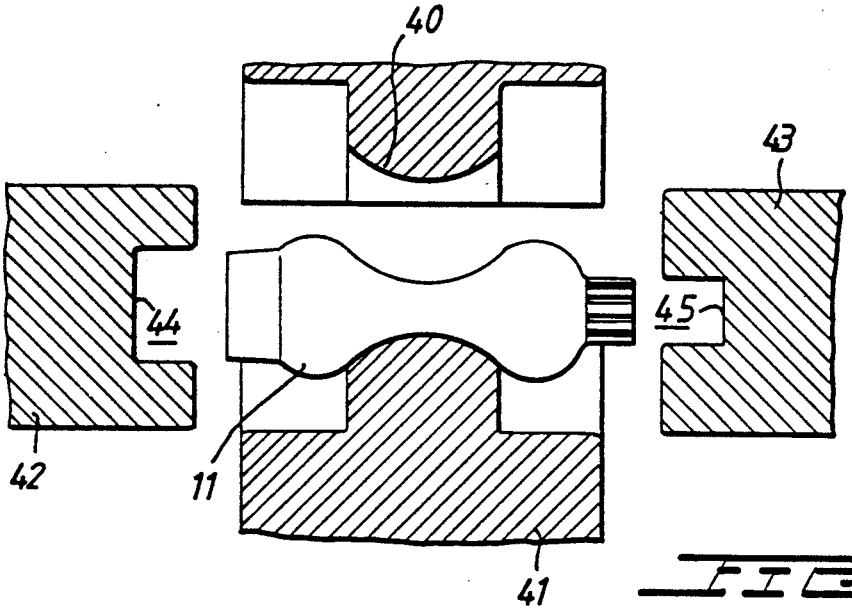
FIGS. 5 and 6 are cross sectional views, illustrating a squeezing process of the method.
Figure 6:
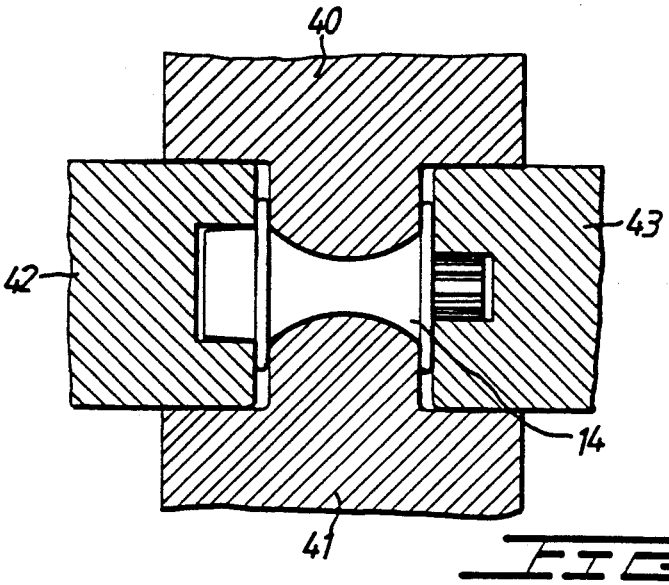

(3) Inserting each semi-product 11 into a mold, as shown in FIGS. 5 and 6.

(4) Squeezing the semi-product 11 to form a hub 14. As shown in FIGS. 5 and 6, there are provided four molds 40, 41, 42, 43. The upper mold 40 and the lower mold 41 embrace the center portion of the semi-product 11. The left mold 42 and the right mold 43 are actuated to squeeze the semi-product 11 so that a hub 14 is formed. It takes about 5 seconds to perform the squeezing process.

(5) Punching holes which are equally spaced on the flange of the hub.

Accordingly, the hub which is manufactured by the method in accordance with the present invention is formed form 15 to 20 seconds which is greatly reduced as compare with that of the conventional method. The productivity thereof is thus greatly increased. In addition, the cylindrical tube 1 is simultaneously hammered or swaged by at least three molds, the compression thereof is homogeneous so that the hub which is accomplished by the method in accordance with the present invention is smooth and homogeneous.

Although this invention has been described with a certain degree of particularity, it is to be understood that the present disclosure has bee has been made by way of example only and that numerous changes in the detailed construction and the combination and arrangement of parts may be resorted to without departing from the spirit and scope of the invention as hereinafter claimed.

I claim:

1. A method of manufacturing a hub comprising: rotary swaging a workpiece which is substantially a cylindrical tube in order to form several semi-products thereon, said workpiece being swaged by at least three dies from an outer peripheral surface thereof, said dies striking or hammering said workpiece in a pulsating hammer-type action so that said semi-products are formed smoothly and homogeneously, and two bearing cup seats are formed on both ends of said semi-product; cutting said semi-products on said workpiece into each semi-product; squeezing both ends of each said semi-product, a center portion of said semi-product being stationarily embraced by an upper mold and a lower mold, both ends of said semi-product being reachable by a right mold and a left mold, and said both ends of said semi-product being squeezed by said right mold and said left mold when said right mold and said left mold move toward said upper mold and said lower mold.

* * * * *